United States Patent [19]

Hamilton

[11] Patent Number: 4,959,902

[45] Date of Patent: Oct. 2, 1990

[54] FINISH GRINDING PROCESS FOR ROTARY DIE CUTTING MACHINE

[76] Inventor: James T. Hamilton, 328 Sycamore Dr., Naperville, Ill. 60540

[21] Appl. No.: 378,055

[22] Filed: Jul. 11, 1989

[51] Int. Cl.[5] ..... B21D 53/12

[52] U.S. Cl. ..... 29/898.07; 29/DIG. 26; 82/101

[58] Field of Search ..... 29/28, 148.4 R, 433, 29/525, 240, 724, 116.1, 129.5, DIG. 26, 56.5; 82/83, 101; 408/23

[56] References Cited

U.S. PATENT DOCUMENTS 3,541,905 11/1970 May .
3,571,299 3/1971 Harden .
4,205,566 6/1980 Molnar .
4,367,576 1/1983 Dikinson ..... 408/22 X
4,617,714 10/1986 Kori et al. .
4,724,599 2/1988 Corkin .

*Primary Examiner*—Timothy V. Eley
*Attorney, Agent, or Firm*—Lee, Mann, Smith, McWilliams & Sweeney

[57] ABSTRACT

A process for finish grinding die and anvil cylinders of a rotary die cutting machine by installing bearings on the cylinder journals, preloading the bearings, and finish grinding the cylinder/bearing assembly on a cylindrical grinder with the bearing assemblies mounted and clamped on grinder steady rests.

12 Claims, 2 Drawing Sheets

FINISH GRINDING PROCESS FOR ROTARY DIE CUTTING MACHINE

BACKGROUND AND SUMMARY OF THE INVENTION

The invention relates to a manufacturing process for rotary die cutting machines wherein tolerances may be predictably achieved. The process is more specifically directed to a cylinder rotary die cutter to provide extended die life. More particularly, the invention relates to a finish grinding process for the cylinders of a rotary die cutting machine.

Rotary die cutting machines for cutting or perforating webs of material are run at high speeds and provide for a die cylinder to contact the web of material between an adjacent, usually counter-revolving, anvil cylinder.

The smaller the manufacturing tolerances for rotary die cutters, the more uniformly the cutters will cut the web of product being fed to them.

With high speed cutters heat build-up can create uneven expansion of the cyliners. It is improtant to maintain the operating tolerance of the cylinders relative to each other and avoid the heat expansion problems. In this regard, by reducing the cylinder total indicated runout (TIR), the die life and running speeds of the die and anvil cylinders can be increased. By reducing the TIR, the interference between the die cylinder and anvil cylinder will be reduced thereby minimizing die deterioration and heat buildup so that the cutting quality on the web of material may be consistently achieved over a longer period of time.

Conventional manufacturing procedures for rotary die cutters require the use of high precision bearings in order to achieve a high predictable precision of the completed die cutter. This requires using Class 3 bearing, which provide the best predictable cylinder gap tolerance achieveable down to about 0.0006 inches. This tolerance error is simply the result of the use of the Class 3 bearings alone. The present invention provides a manufacturing process that will allow the use of less precise Class 2 or 4 bearings but will achieve a much higher predictable cylinder gap tolerance of 0.00008 inches and better. This is seven and one-half times more precise then the prior art use of Class 3 bearings. The major advantage of the present invention is the improved cylinder tolerance while using less precise bearings and greatly reducing cost. Shorter delivery times are also achieved by using the less precise bearings.

It is an allied goal of the invention to greatly increase the die life by providing a method for making die and anvil cylinders with very close TIR tolerances that reduce the gap variations between the cylinders. This goal thereby reduces the extent of die-to-anvil impingement or contact to only that which is requireed in order to maintain consistent cutting of the web of material passing between the cylinders. This reduction of interference will further eliminate much of the risk in developing destructive harmonic resonance during high speed operation.

It is a related object to provide a finishing process for rotary die cutter cylinders that makes possible considerably less frequent resurfacings of the anvil cylinder.

The invention may be summarized as a manufacturing process for making the die and anvil cylinders of a rotary die cutter which produces a predictable die-to-anvil gap tolerance in the completed rotary die cutting machine. The tolerance is several times more accurate than can be predictably achieved by prior art methods used for manufacturing rotary die cutters. The process involves the finish (cylindrical) grinding of the die and anvil cylinders by rotating the cylinders in the same preloaded bearings that are to be subsequently operated in the die cutting machine. Since the die and anvil cylinders, with preloaded bearing assemblies, are finish ground, they are kept in the assembled state and mounted in a die cutter side frame. Prior art processes for making die and anvil cylinders provide for the finish (cylindrical) grinding of the cylinders as they are rotated on centers or their bearing journals whereby there is no elimination of the bearing tolerances because the bearings are mounted separately after the finish grinding of the cylinders. Thus compounded errors of each machined tolerance results in conventional processes and the predictability of the tolerance of the completed machine is uncertain. The present invention overcomes this major obstacle found in the art.

DETAILED DESCRIPTION OF THE INVENTION

Figure 1:
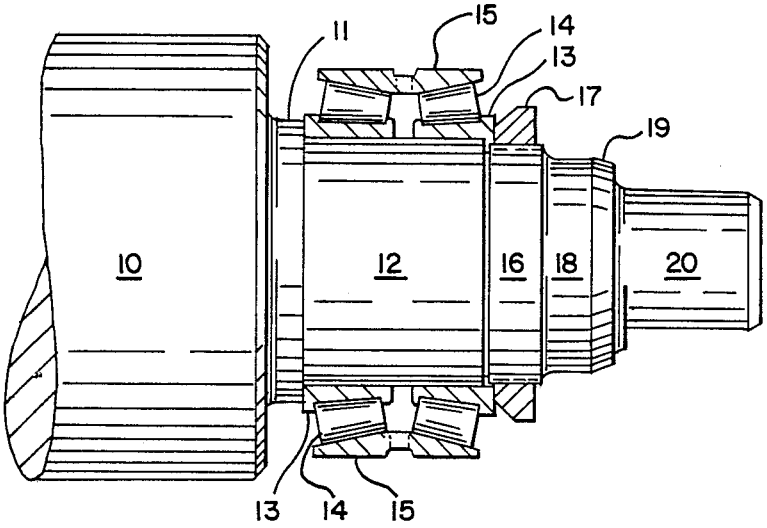
FIG. 1 is a side view of one end of a rotary die cutter cylinder and journal bearing assembly shown in section and being preloaded thereon.

With reference to the Figures, like reference numerals throughout refer to the same elements.

Turning to FIG. 1, a generally known configuration for a rotary die cutting cylinder 10 and bearing assembly is shown. The cylinder 10 is shown generally at one end thereof and having an axially extending first shaft portion 11 that is adjacent a journal portion 12 having an inner bearing race 13. Tapered roller bearings 14 reside between the inner bearing race 13 and an outer bearing race 15, which provides the outer bearing surface for the rotation of the tapered roller bearings 14. Projecting further in the axial direction is a smaller diameter shaft portion 16 which threadingly engages a preload locking nut 17 therearound for securing the journalled bearing assembly 12–15 and for preloading the bearings according to the manufacturer's specifications.

Extending axially outward of the preload locking nut 17, a reduced shaft portion 18 tapers at 19 to terminate in an end portion 20, which portion 20 would be secured to drive gear means when the cylinder 10 is installed in a rotary die cutting machine. The installed arrangement of the cylinder 10 will be shown, for purposes of explanation, with respect to FIG. 3 discussed below.

Figure 2:
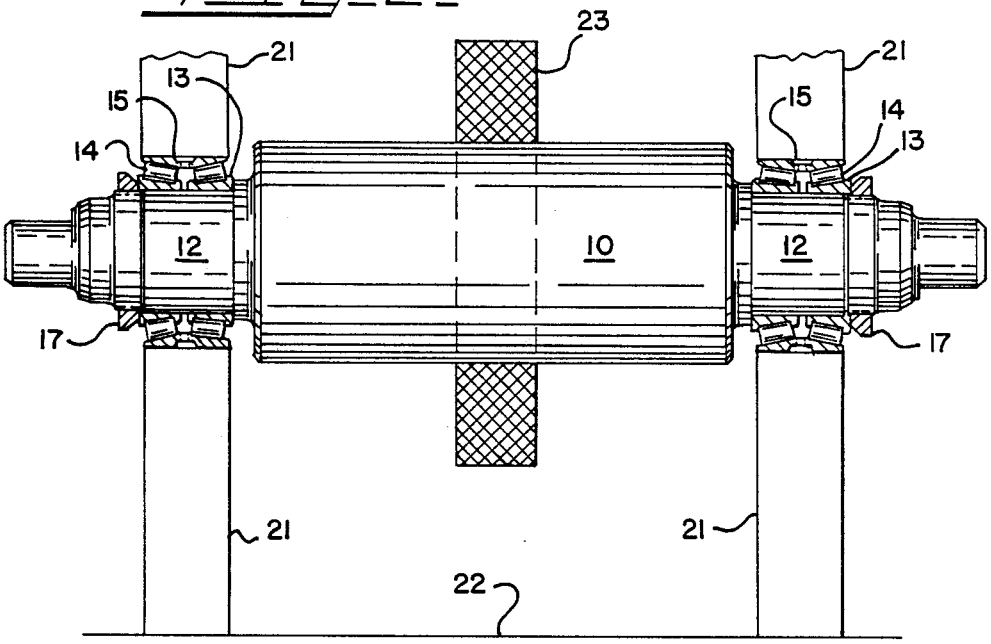
FIG. 2 is an elevational view of a die cutter cylinder having the journal and bearing assemblies shown in section, preloaded at opposite ends thereof, and mounted at a stationary steady-rest support at a grinder bed for finish grinding thereof.

Upon preloading the journalled bearing assembly 12–15, the rough ground cylinder 10 is ready to be ground to a higher precision than accomplished in prioir art techniques. The cylinder 10 is then rotatably supported and clamped at the journalled bearing assembly 12–15 on a cylindrical grinder steady rest 21 at the bed 22 of a cylindrical grinder, as shown in FIG. 2. A cylindrical grinding wheel 23 is illustrated for the finish grinding step and shown in a conventional arrangement wherein the grinding wheel 23 laterally traverses back and forth across the surface of the cylinder 10 to achieve a high degree of precise grinding and greatly reduced TIR down to about 40-millionths (0.00004) inches. Grinding is repeated until the cylinder TIR is within specification.

With Class 3 bearings, the most precise, a TIR tolerance of 0.0003 inches is obtained so that when two are used—one at each cylinder end—the compound predictable TIR tolerance would be 0.0006. The class 2 or 4 bearings, have less precision falling in the range from about 0.0006 to 0.0008 of runout for the assembled bearings which would predicatabaly have twice that tolerance when operated, i.e. 0.0012 to 0.0016. The present invention allows for the reduction of the TIR of the assembled cylinder and bearings to 0.00004 inches predictably which results in cylinder gap tolerance in an assembled machine of double that tolerance, namely about 0.00008 inches. Since the individual roller bearings 14 for classs 2, 3, & 4 bearings are made with a tolerance within 0.000005 inches diameter, it is possible for the present invention to allow one to reach a predictable tolerance of about 0.00001 inches TIR by means of additionally taking further finish grinding steps which will eliminate all of the elemental tolerances except the roller 14 tolerance.

The measurement of TIR is the lineal measurement of the movement of the circumference of the cylinder when spun on its axis. This is unlike the static measurement of the circumference of the cylinder which determines the perfection of the shape of the cylinder circle. Thus, TIR is a measure of how close the cylinder rotates in and out of a perfect circlular path.

In providing for the complete assembly of the journalled bearing assembly 12–15 with the cylinder 10, the precise tolerance is achieved by finish grinding the combined cylinder and bearing assembly whereby the same journalled bearings used during the finish grinding are directly installed with the cylinder in the die cutting machine. Thus, the compounding of various machine tolerance error is avoided.

Upon the finish grinding of one cylinder 10, e.g., the die cylinder, the anvil cylinder having the same arrangement of a journalled bearing assembly is preloaded and the finish grinding is then made to the anvil cylinder. Then the second or anvil cylinder may be taken and installed in the rotary die cutting machine adjacent the die cutting cylinder.

Figure 3:
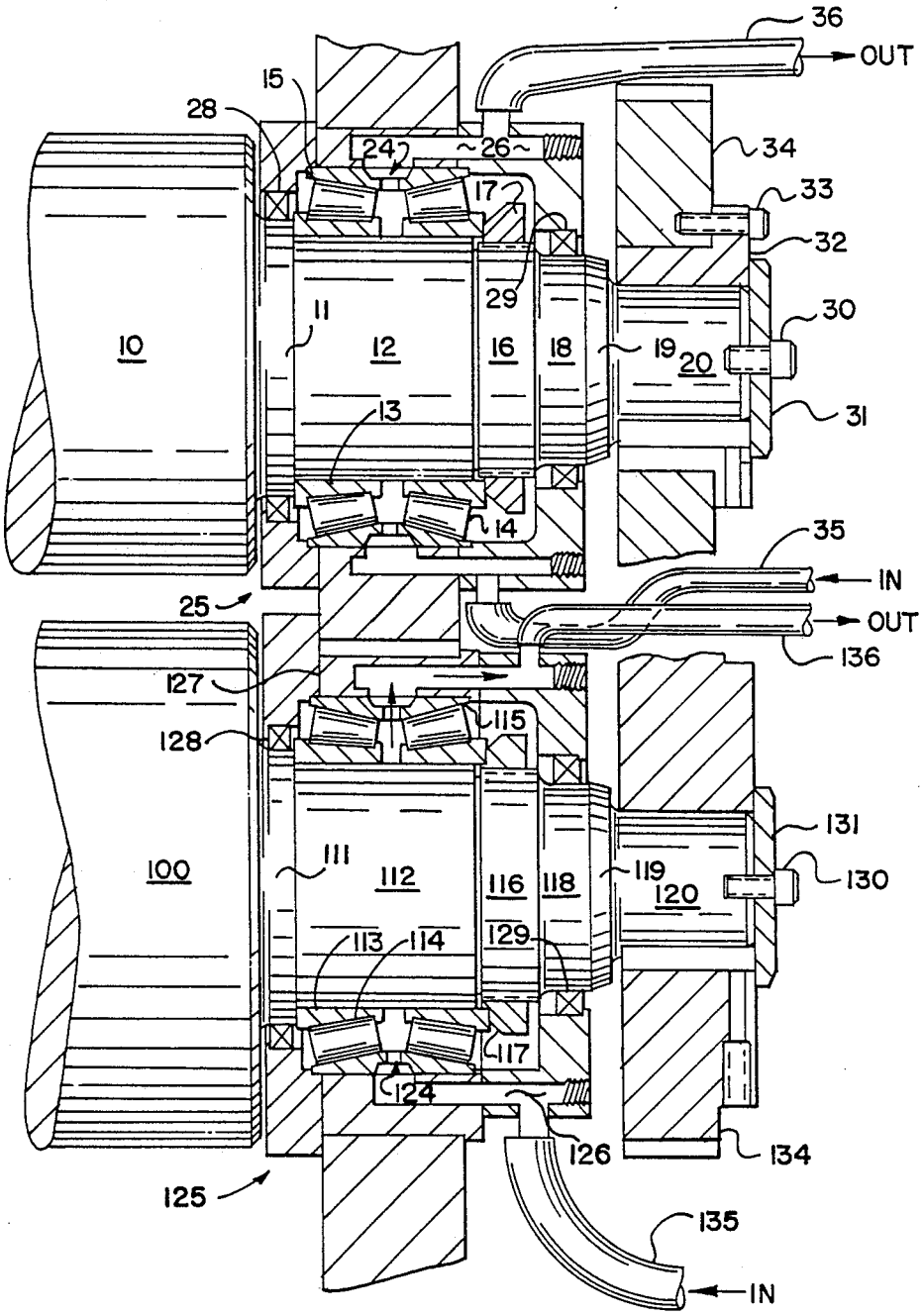
FIG. 3 is a partial sectional view of a rotary die cutting machine at one end thereof and showing the die cylinder mounted above the anvil cylinder both having journalled bearing assemblies at shaft ends thereof and being driven by a drive gear means for counter-rotating the die and anvil cylinders to treat a web of material passing therebetween.

For purposes of complete explanation, attention is now directed to FIG. 3 wherein the die cylinder 10 is shown mounted above an anvil cylinder 100 in a known arrangement wherein corresponding components 111–120 are the mirror image components of components 11–20 for the die cylinder 10 shown in FIG. 1, as would be understood. The outer bearing race 14, 114, shown in a sectional view, provides a flow passage 24, 124 for lubricant/coolant that extends therethrough to communicate with an outward passage 26, 126. A bearing housing, generally at 25, 125, supportably surrounds the bearing assemblies and accommodates the flow passages 26, 126 therebetween. For the anvil cylinder 100, the exterior side of the passage 126 is also bounded in part by an eccentric ring 127 which is assembled with the bearing housing 125 for adjusting the spacing of the cylinders 10, 100. Seals 28, 128 and 29, 129 seal around the shaft portions 11, 111 and 18, 118, respectively, for maintaining the coolant and lubricant within the bearing housings 25, 125. The end portion 20, 120 of the shaft is locked by screw fasteners 30, 130 to a plate 31, 131. In the case of the die cylinder 10, a circumferential body portion 32 fits around the shaft portion 20. The plate 31 secures the body portion 32 to the end portion 20 and further is secured by a means of a second and ajustable screw fastener 33 to a die drive gear 34. The adjustable screw fastener 33 permits for the rotation of the body portion 32 relative to the drive gear 34 which gear tooth engages an anvil drive gear 134 that is secured to the shaft portion 120 by the screw fastener 130 and the plate 131. The adjustable fastener 33 permits the relative rotation of the die cylinder gear 34 to the anvil gear 134 for synchronizing the gear tooth engagement as is known in the art.

Inflow line 35, 135 and outflow line 36, 136 communicate with the passage 26, 126 for the recirculation of coolant and lubricant around the journalled bearing assembly 12–15, 112–115, as would be clear to those skilled in the art.

Upon installing the cylinders 10 and 100 in a rotary die cutter as shown in FIG. 3, the preloaded journal bearings and cylinders will rotate with the precise tolerances attained through the finish grinding of them as an assembly instead of mounting a cylinder to separately machined journal bearing assemblies at either end, which inherently can compound all machine tolerance errors and exacerbate TIR problems.

In the disclosed embodiment, the journalled bearing assembly 12–15 and 112–115 is tightened down at the preload lock nut 17, 117 to a manufacturer's design specification of about 32 inch-pounds required to rotate the bearing.

The maintenance of precise TIR results in increased die life at high running speeds since the required clearance between the cylinders 10 and 100 can be kept much longer than with conventional machining procedures for rotary die cutting components. For example, in the disclosed embodiment as shown in FIG. 3, it is envisioned that the cylinders 10 and 100 would rotate at from about 150 to 800 rpm with a web of material to be die cut passing between them at a feed rate of up to about 1600 feet per minute. Usually, rotary die cutting devices will have repetitive patterns thereacross for the simultaneous die cutting of a plurality of similar shapes at once, such as articles made of cardboard, plastic, paper, foil and the like. The width of the cylinders 10, 100 typically are in the range of from about 4 inches to 48 inches. Thus, holding the correct tolerance across this length is critical. Finish grinding the cylinders mounted with preloaded bearings achieves this long felt need and greatly increases die life and running speeds.

The inventive process is also useful for finish grinding of cylinder used in perforating machines, wherein cylinders may revolve in a counter-revolving manner, as in the disclosed embodiment, or may revolve in the same angular sense. In the latter, the cylinders move in opposite directions at the point of contact with the web of material.

The predictability achieved by the invention is defined by the expected TIR of the assembled die and anvil cylinders to about 40 millionths TIR, or less, for each cylinder finish ground by the process described. Thus, the close tolerance gap between the die and anvil cylinders 10 and 100 will increase the die life and allow for much higher running speeds. For example, the predictable tolerance improvement of seven and on-half times (calculated by doubling the Class 3 tolerance (0.0003) and dividing it by two times the TIR achieved by the present invention (0.00004inches)) extrapolates into a comparative improvement of die life and higher running speeds wherein the die will last over seven times longer if run at the same speed or alternately can run at seven times the speed with no improved lifetime. The present invention solves a long felt need for increased die life and running speeds.

Although the die and anvil cylinders 10 and 100 are shown to be smooth, they may have relief to form patternas to be cut as is known, and capable of being finish ground by the inventive process herein disclosed.

While the invention has been described with regard to an exemplary embodiment, it will be understood that a wide range of equivalents fall within the scope of the claims appended hereto.

What is claimed is:

1. A process for finish grinding a cylinder for a rotary die cutting machine comprising the steps of:

assembling roller bearings on a cylinder shaft journal;

preloading the bearings to manufacturer specifications;

rotatably supporting the assembled roller bearings on finish grinder steady rests; and, finish grinding the cylinder to achieve a desired total indicated runout (TIR).

2. The process as claimed in claim 1 wherein the step of assembling the roller bearings comprises assembling tapered roller bearings on the cylinder shaft journal.

3. The process as claimed in claim 1 wherein the step of rotatably supporting the cylinder and roller bearing assembly comprises rotatably supporting the assembly on cylindrical finish grinder steady rests.

4. The process as claimed in cliam 1 wherein the step of finish grinding the cylinder comprises finish grinding the cylinder until the total indicated runout is 40-millionths of an inch (0.00004 inches) or less.

5. The process as claimed in claim 1 wherein the step of assembling the roller bearings on the cylinder shaft journal comprises assembling roller bearings on a cylinder having relief.

6. A process for finish grinding a cylinder of a two cylinder rotary die cutting machine comprising the steps of:

assembling tapered roller bearings on opposite bearing journals of the shaft of a cylinder;

preloading the roller bearings to a desired torque specification;

supporting the cylinder at said roller bearings in a freely rotatable manner on a cylinder grinder; and finish grinding the cylinder.

7. The process as claimed in claim 6 wherein the step of assembling the roller bearing comprises assembling Class 2, 3 or 4 tapered roller bearings.

8. The process as claimed in claim 6 wherein the step of finish grinding the cylinder comprises finishing to achieve a 40-millionths of an inch total indicated runout (TIR) or less.

9. A process for finish grinding a die cutter cylinder comprising:

rough finishing a die cutter cylinder;

assembling roller bearings onto cylinder bearing journals;

preloading the roller bearings to manufacturer design specification;

mounting the cylinder at said roller bearings on steady rest assemblies of a grinder bed; and, finish grinding the cylinder.

10. The process as claimed in claim 9 wherein the step of assembling the roller bearing into the cylinder journal comprises assembling tapered roller bearings.

11. The process as claimed in claim 9 wherein the step of preloading the bearings comprises tightening preload locking nut means adjacent the cylinder bearing journals.

12. A process as claimed in claim 9 including the further step of removing the finish ground cylinder and bearing assembly from the grinder and installing the assembly in a rotary die cutting machine.

* * * * *